US006584992B2

(12) United States Patent
Brynolf

(10) Patent No.: US 6,584,992 B2
(45) Date of Patent: Jul. 1, 2003

(54) CLEANING SYSTEM AND METHOD

(75) Inventor: Russell Brynolf, Howell, MI (US)

(73) Assignee: Patent Holding Company, Fraser, MI (US)

( * ) Notice: Subject to any disclaimer, the term of this patent is extended or adjusted under 35 U.S.C. 154(b) by 157 days.

(21) Appl. No.: 09/879,424

(22) Filed: Jun. 12, 2001

(65) Prior Publication Data

US 2002/0185159 A1 Dec. 12, 2002

(51) Int. Cl.[7] ..... B08B 3/00
(52) U.S. Cl. ..... 134/131; 134/78
(58) Field of Search ..... 134/131, 78, 61

(56) References Cited

U.S. PATENT DOCUMENTS 4,765,020 A * 8/1988 Weihe ..... 15/302
5,749,383 A * 5/1998 Parslow, Jr. ..... 134/56 R
5,758,674 A * 6/1998 Taeger ..... 134/131
6,196,238 B1 * 3/2001 Choi et al. ..... 134/58 R

* cited by examiner

*Primary Examiner*—Randy Gulakowski
*Assistant Examiner*—Saeed Chaudhry
(74) *Attorney, Agent, or Firm*—Welsh & Katz, Ltd.

(57) ABSTRACT

The present invention comprises a conveyor assembly for carrying an item that has been painted by over-spray or dipping to a cleaning chamber where a cleaning means, typically a high pressure water cleaning device, is used to remove paint layers from an inadvertently painted item. The cleaning chamber further comprises a pool having an elongated drainage element such that water may be drained off from the top of the surface of the pool while the paint layers are deposited into the pool. The paint layers may subsequently be removed from the pool and disposed of properly. The invention further comprises a method of using the cleaning chamber, high pressure water cleaning device, pool and drainage device to clean items used to hold items to be painted.

11 Claims, 3 Drawing Sheets

CLEANING SYSTEM AND METHOD

FIELD OF THE INVENTION

The present invention concerns a novel system and method for the cleaning of an object. More particularly, the present invention is, in a preferred embodiment, a high-water pressure cleaning system intended for use in association with industrial spray painting applications, such that it is useful to aid in the removal of paint over-spray from devices which are used to hold items which are being painted.

BACKGROUND OF THE INVENTION

The use of spray painting equipment, while speeding up the process and improving the quality of painting, presents difficulties of its own. Most particularly, once paint is emitted from a spray gun or painting device (such as an air brush or aerosol can) it typically adheres to whatever object it first encounters, regardless of the painter's chosen target. Paint which strays from its intended object is generally referred to as over-spray by persons having skill in the art. Other methods of painting, such as brushing or dipping generally do not present the problems of over-spray, however, in every manner of applying paint there is some type of device which must be cleaned of excess paint when the painting is completed. With respect to brush painting, typically, there is at least one brush and a bucket to clean after painting, with respect to dipping, the apparatus used to hold the item during dipping must typically be cleaned. With respect to spray painting, typically the bracket used to hold the item to be painted is painted by over-sprayed, and must be cleaned.

In the automotive field, bumper covers, and other metal and plastic parts, are typically spray painted by first attaching the part, on its unadorned side, to a bracket and then painting the exposed area with a spray painting device. In modern operations a robotic spray painting device, having articulating movements resembling a human hand, wrist and arm, may be used.

The robotic spray painting device, typically, is instructed (by computer program) to paint the exposed section of the item to be painted and to over-spray paint the unadorned side so that a continuous coat of paint is created. As a result some coating protection is provided to the unadorned, and generally unseen, side of the item. For example, a rubber bumper cover may be attached to a bracket at its rearward side, a spray painting robot is then instructed to proceeds to apply a coat of paint to the front, or exposed, side of the bumper.

The robotic device, through articulations of its arm, wrist and hand, paints the bumper and, to provide a more complete protection, for the paint, a good portion of the rear of the bumper. Such an application of paint allows the front side coat to be a complete coat, such that the layer does not end within the boundaries of the front of the bumper. In this manner, a better looking coat of paint is applied and, as a result of continuing to the back side of the bumper, better adhesion of the paint to the bumper is achieved.

As a result of painting on the rear side of the bumper, and, further, as a result of the paint penetrating through openings in the item to be painted, the bracket which holds the item to be painted generally is, inadvertently, painted as well. Typically, the bracket, or other holding assembly, is manufactured having a smooth, typically, non-stick surface such that paint does not adhere. However, after a number of over-sprays, and due to the adhesive nature of paints used in spray application, paint does adhere to the bracket or other holding device and, subsequently, to each of the previous layers of paint over-spray on the bracket. Such over-spray paint becomes a problem when a plurality of layers have been sprayed onto the bracket or holding device.

The extra thickness of paint layers typically interferes with and/or blocks the flow of paint to the item to be painted and the extra weight of the paint on the bracket can cause problems with the movement of the bracket to the painting station, and/or the manner in which the item to be painted and the bracket are attached together. Further, the added weight and concomitantly increased awkwardness of the bracket can cause a slowing down of the painting operation. Other problems, due to excess paint on a bracket, are known to those having skill in the art.

Cleaning of equipment used in painting operations has typically entailed removing a bracket from a painting assembly line and having a person manually clean the bracket before returning it to use. Some methods of cleaning include dipping the bracket in paint solvents and the use of a water hose and/or other cleaning means to physically strip the bracket of layers of paint. In the former method, harsh and toxic chemicals have been found to be hazardous to the employee and to the environment. Chemicals which have been found to be safe for a person and/or the environment, are often ineffective. In the latter method, an employee must spend considerable amounts of time in order to remove the plurality of paint layers typically formed on a bracket. Further, such workers may get soaked from using a hose to clean adhered layers of paint from a bracket, and can suffer from exposure to water and/or cleansers and chemicals from the paint.

Also, in such cleaning operations layers of paint flakes are scattered in large areas around the cleaning site, requiring that the worker spend a considerable amount of time policing the clean-up area of all paint or hazardous materials. Further, such paint flakes typically comprise hazardous chemicals which pollute the area during such cleaning operations and are often washed into sewer or storm drainage systems, producing hazards downstream. It has been found that such manual cleaning of brackets (and the like) is often ineffective, allowing paint to collect more rapidly during the next cycle of painting, requiring more frequent cleanings.

SUMMARY OF THE INVENTION

In accordance with the present invention a cleaning system, comprising a conveyor and a cleaning chamber, about a portion of the conveyor, is provided. A cleaning device, within the cleaning chamber is also provided. The cleaning device is operable to convey fluid towards an item to be cleaned. Further, a fluid-tight receptacle, such as a pool, beneath the conveyor and within the cleaning chamber is also provided. The receptacle contains an elevated drainage member such that fluid conveyed onto an item to be cleaned, and solid substance removed from items to be cleaned, may drop into the receptacle. Upon the collection in the receptacle, of sufficient fluid, the fluid subsequently pours into openings in the elevated drainage member, while solid substances, removed from items to be cleaned, remain in the receptacle.

In one embodiment of the present invention, the cleaning system comprises a high pressure device, for physically removing layers of paint from items. In this embodiment a conveyor system, comprising a conveyor belt, or other conveyance system, having a bracket attached thereto is provided to convey an over-spray-painted bracket to a cleaning chamber. The cleaning chamber is placed about a portion of the conveyor system such that the conveyor system runs through the cleaning chamber. A directional high-water-pressure cleaner is placed within the cleaning chamber and a pool is located beneath the conveyor system, within the cleaning chamber. The pool contains an elevated drainage member such that water sprayed, onto an item to be cleaned, and paint removed from items to be cleaned, drops into the pool. The water in the pool subsequently rises to the level of the elevated drainage member while the paint sprayed off of the item to be cleaned falls to the bottom of the pool. After a plurality of cleaning cycles the pool may be drained, using a secondary draining device (such as a sealable drain in the floor of the pool) having a particulate filter. After drainage of water the paint layers may be removed, and disposed of, properly.

In one embodiment of the present invention, the conveyor system comprises an overhead monorail type system having a hanger assembly onto which items to be cleaned may be suspended. The hanger assembly further comprises rods for attachment to the item to be cleaned, such that the item is held still for cleaning.

In another embodiment, the conveyor system comprises a belt onto which items to be cleaned may be attached for cleaning.

It is therefore an object of the present invention to provide a device and method for cleaning brackets and other holding devices used to hold items that are spray or dip painted and which are inadvertently painted by over-spray or dipping.

It is another object of the present invention to provide a device and method for cleaning such brackets or holders that is safe for the user and the environment.

It is another object of the present invention to provide a system and a method of using the system that allows the removal of paint, from a bracket, such that layers of paint flakes are contained and may subsequently be disposed of properly.

Other objects and advantages of the present invention will become apparent as the description proceeds. A more detailed explanation of the invention is provided in the following description and claims and is illustrated in the accompanying drawings.

DETAILED DESCRIPTION OF AN ILLUSTRATIVE EMBODIMENT

Figure 1:
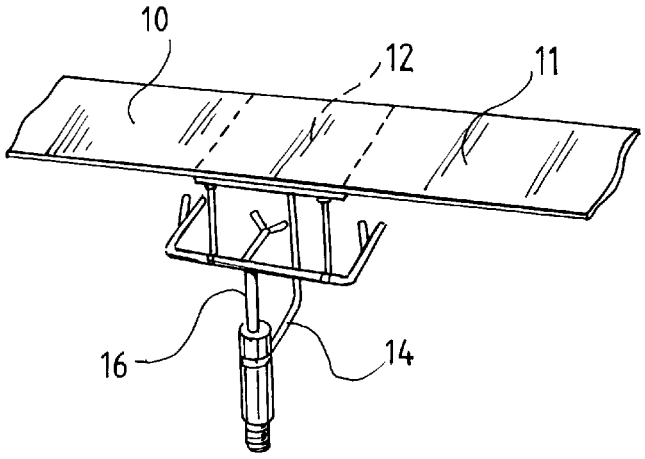
FIG. 1 is a partial view of an overhead conveyor system with a hanger assembly of the present invention, holding a painting bracket.
Figure 2:
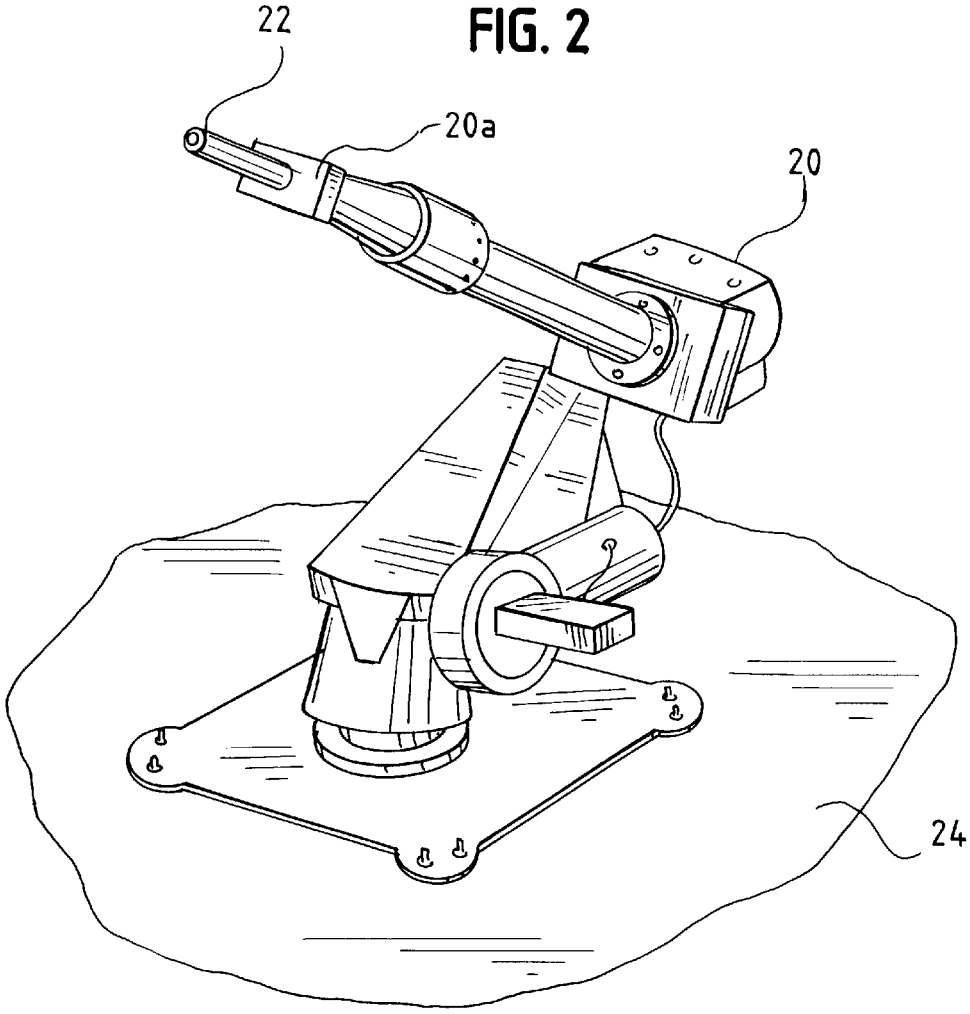
FIG. 2 is a high pressure robotic cleaning device of the present invention.

While the present invention is susceptible of embodiment in various forms, there is shown in the drawings a number of presently preferred embodiments that are discussed in greater detail hereafter. It should be understood that the present disclosure is to be considered as an exemplification of the present invention, and is not intended to limit the invention to the specific embodiments illustrated. It should be further understood that the title of this section of this application ("Detailed Description of an Illustrative Embodiment") relates to a requirement of the United States Patent Office, and should not be found to limit the subject matter disclosed herein.

The present invention relates most specifically to system and method of removing paint over-spray from brackets, and other equipment, used in industrial painting applications. Referring to the diagrams, FIG. 1 shows a partial view of the overhead conveyor system 10 of the present invention. The conveyor system 10 comprises a conveyor belt 11 and a hanger assembly 12 comprising a plurality of rods 14 for holding a painting bracket 16 in a stabile hanging configuration. It is to be understood that while rods 14 are shown, any manner of suspending bracket 16 from hanger assembly 12, such as cables or any other suspension system, may be substituted, by persons having skill in the art, without departing from the novel scope of the present invention. It is to be further understood that while an overhead conveyor system 10 is shown, other types of conveyor systems, or other means to convey bracket 16 from a first point to a cleaning chamber 18 (FIG. 3) may be substituted without departing from the novel scope of the present invention.

Conveyor system 10 further comprises a robotic cleaning device 20. Robotic device 20 is of a type well known in industrial applications, including such applications as painting, material handling and cleaning operations. Robotic device 20 is functionally a computerized programmable articulating arm and wrist capable of accepting and acting upon instructions. Such devices are typically electrically operated and comprise means to accept commands and perform remedial repetitive tasks. In the illustrative embodiment, robotic device 20 further comprises a water inlet (not shown), and means to cause water to be expelled, accurately and with great force, towards an object to be washed. In another embodiment, robotic device 20 may include means to add cleansers, polishers or protective chemicals to the device to be cleaned. As illustrated, robotic device 20 further comprises a fluid outlet 22 at its distal end 20*a*.

It is to be understood that such robotic devices are well known in the art and movements, by such devices, which imitate the movements of a human arm, wrist and hand, are well known and typically accomplished by such devices. Robotic device 20, and other similar devices, are typically programmed to perform repetitive tasks with precision. Programming such a device to provide a stream of water at high pressure, such that a cleansing spray is provided to a great proportion of the over sprayed area is well known in the art. In the present invention, robotic device 20 is placed within cleaning chamber 18, typically such that it is bolted to a concrete, or other hard, stable and durable surface 24 (FIG. 4).

Figure 3:
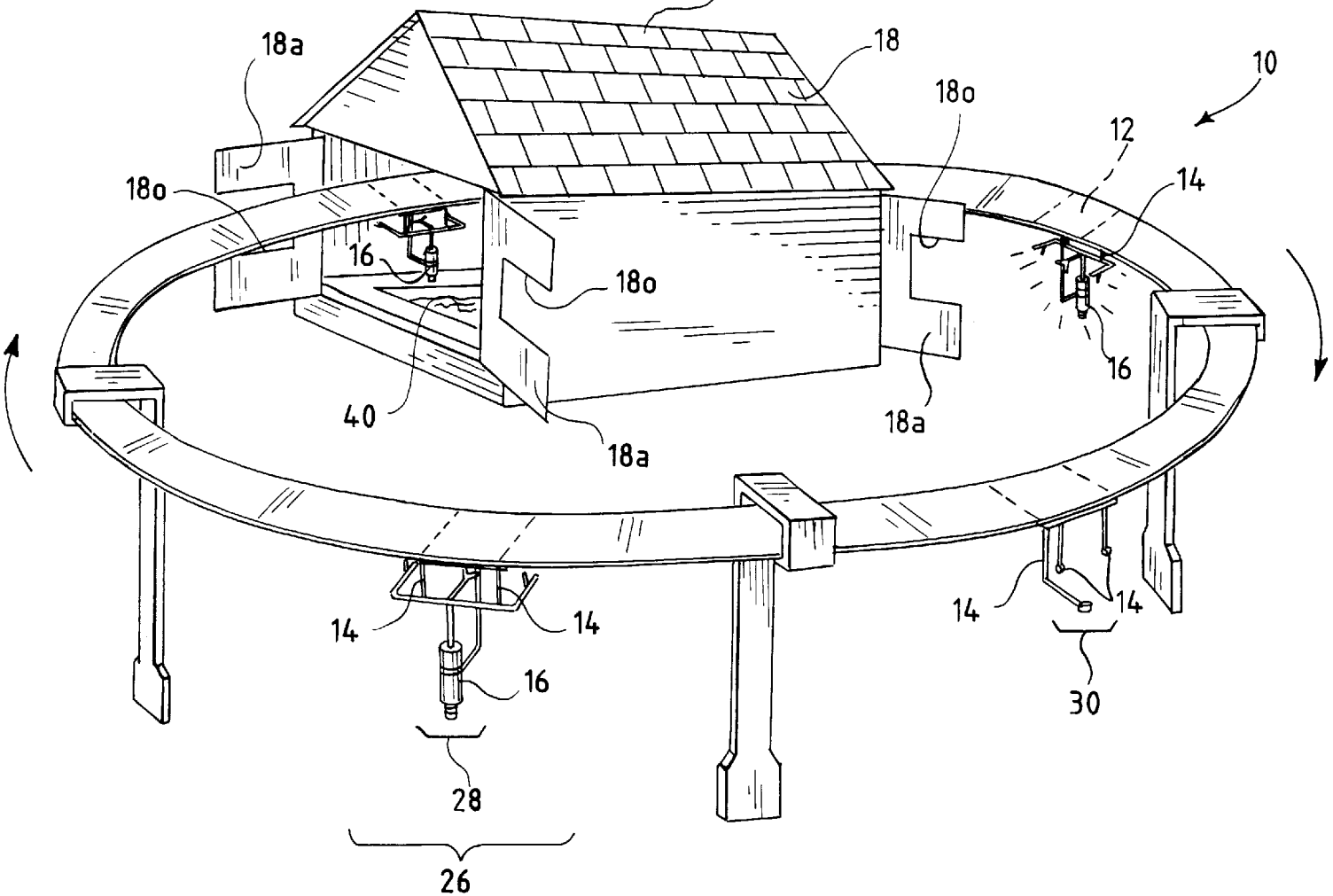
FIG. 3 is a perspective view high pressure cleaning circuit of the present invention.

Referring now to FIG. 3, it can be seen that a conveyor system 10 is provided in a circuit 26 with a cleaning chamber 18. Further, a device mounting point 28 and a device dismounting point 30 are also provided. It is to be understood that, for illustrative purposes, mounting point 28 and dismounting point 30 have been chosen at random on conveyor system 10. It will be understood by persons having skill in the art that mounting and dismounting points on the conveyor system of the present invention may be placed in any desirable location along conveyor system 10. Further, it will also be understood that mounting and dismounting of items designated for cleaning, can be made, if desired, at the same point on the conveyor system.

Figure 4:
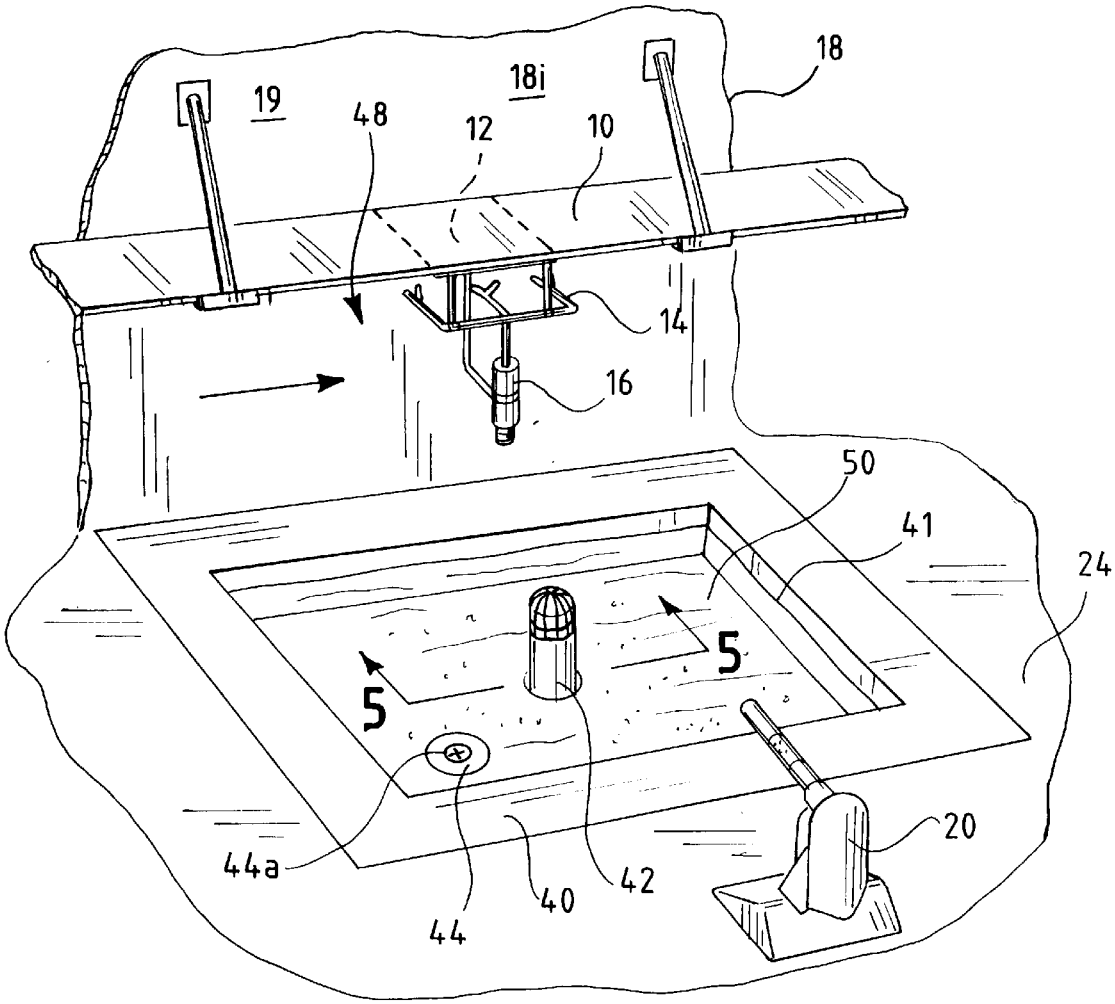
FIG. 4 is a partial perspective view of the interior of the cleaning chamber of the device of the present invention.
Figure 5:
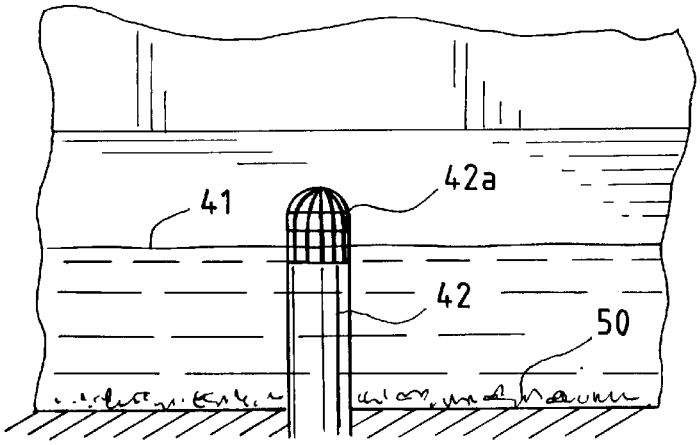
FIG. 5 is a cross-sectional view of the cleaning chamber showing an elevated drainage member of the device of the present invention.

FIG. 4 is illustrative of the interior of cleaning chamber 18. Cleaning chamber 18 is illustrated as a building 19 within which conveyor 10 travels as part of a circuit, as explained in greater detail below. Chamber 18 further comprises a sunken fluid-tight receptacle 40 having a first drainage means 42 and a second, resealable, drain 44. Fluid-tight receptacle 40 is illustrated as a swimming-type pool or an industrial, in-ground-water tank. It is, however, to be understood that fluid-tight receptacle 40 can be configured in any manner, which would allow the collection of fluid and debris, and the subsequent drainage of fluid away from the debris, without departing from the novel scope of the present invention.

Cleaning chamber 18 further comprises a robotic cleaning device 20 and a means to power and provide control direction to robotic device 20. Further, cleaning chamber 18 further comprises a source of cleaning fluid (not shown) and a spray zone 48, located generally between the distal end 20*a* of robotic cleaning device 20 and an interior wall 18*i* of cleaning chamber 18. In a preferred embodiment, of the present invention, the fluid used to clean items is water, at high pressure and speed. It is to be understood, however, that any fluid typically used for cleaning purposes and/or any fluid usable at high pressure and speed, may be substituted without departing from the novel scope of the present invention. Further, it is to be understood that gases at high speed and pressure, or gasses mixed with granular or particulate elements (such as sand, mica or other fine stones or elements) may be used in a device of the present invention without departing from the novel scope of the present invention. Therefore, cleaning chamber 18, depending on the embodiment of the invention utilized, comprises means to provide cleaning fluid, water or gas and/or gas with particulates, through outlets (not shown) but well known in the art.

Conveyor system 10 is shown as complete circuit, such that an item placed on conveyor belt 11 will travel from mounting point 28 into cleaning chamber 18 and to dismounting point 30 in due course. The operation of cleaning an item within circuit 10, and more specifically within cleaning chamber 18, occurs during the course of an item's travel through circuit 10.

In the operation of the cleaning system of the present invention, an item to be cleaned, typically a mounting bracket 16, of the type such as a bracket used to hold a bumper cover during painting, is attached to hanger assembly 12 using rods 14, or other means to attach the item and have it maintained in a generally fixed, i.e. not swinging, manner. Bracket 16, which is typically coated with a plurality of layers of paint is attached to assembly 12 at mounting point 28, using hanging assembly 12. Assembly 12, in the illustrative embodiment, is attached to conveyor belt 11 so as to permit travel along conveyor circuit 10 towards cleaning chamber 18.

Upon entry into cleaning chamber 18, cleaning chamber doors 18*a* can be closed so as to prevent cleaning fluids and/or paint or other debris from being expelled beyond cleaning chamber 18. As illustrated (FIG. 3), doors 18*a* are provided with openings 18*o* to facilitate the opening and closing of the doors without interrupting or interfering with conveyor belt 11. It is to be understood that various other means of providing a closed cleaning environment may be utilized by persons having skill in the art without departing from the novel scope of the present invention. A cleaning system wherein a device to be cleaned is individually placed or hung within a cleaning chamber, the chamber doors are sealed, and a robotic (or other) cleaning device is implemented to clean the item, is contemplated as being within the scope of the present invention. Further, it is envisioned that the present invention can include means, known in the art, for closing doors 18*a* using pre-programmed electrical or electromechanical means. The complete programming of the entire loading, conveying, sealing the cleaning chamber, cleaning the item, opening the cleaning chamber, conveying the cleaned item and unloading the item, of the system and method of present invention, is within the novel scope of the present invention.

Upon a bracket 16 reaching the spray zone, or cleaning zone, 48, a pre-programmed cleaning routine is initiated using robotic device 20. The cleaning routine may include the acquisition of appropriate cleaning fluids, or other cleaning means, and the directional expulsion, through outlet 22, of the cleaning means by robotic device 20. The cleaning program may, further, include instructions for the articulated movements of robotic device 20 such that generally every part of the surface area of bracket 16 is subjected to a forced fluid cleaning, and may, as necessary include programming to spray with greater or lesser force at specific areas of the target as needed.

As illustrated (FIG. 4), cleaning zone 48 is typically an area located above fluid-tight receptacle 40 within cleaning chamber 18. It will be understood, by persons having skill in the art, that subjecting bracket 16 to the force of fluid expelled from robotic device 20 will generally cause fluid to be sprayed, and ricocheted, about the interior of cleaning chamber 18. Concomitantly, layers of paint 50 will be forced off of bracket 16 and will also be sprayed about the interior of cleaning chamber 18. Subsequent to being sprayed off of bracket 16, however, fluid and paint layers 50 will be caused (due to gravity and/or through subsequent cleaning steps within chamber 18) to flow into receptacle 40. As debris and fluid are collected in receptacle 40, the fluid expelled from robotic device 20 will form a pool 41 of fluid and the paint layers 50, due to the specific gravity of paint, will sink to the bottom of pool 41 in receptacle 40. As the level of pool 41 rises, fluid will be drained off through openings 42*a* in elongated drain means 42. For fluids other than water, a disposal tank (not shown) may be connected, through suitable plumbing (not shown) to appropriate drainage means 42 and/or storage means (not shown); water may be drained directly into municipal sewers or storm sewers. It is to be understood that fluids used in the method of the present invention may also be collected, filtered to remove impurities, and reused in device 20 of the present invention.

Upon completion of the cleaning of a plurality of brackets 16, and the collection of significant amounts of paint layers 50 in receptacle 40, the collection and permanent disposal of paint layers 50 will be required. Disposal of paint layers 50 may be accomplished in any number of ways, however, one embodiment of the present invention provides a second drain means 44 for removal of fluids in receptacle 40, so as to facilitate removal of paint layers 50. In the operation of the present embodiment, a resealable drain 44, of a type having filtering means such that water may be removed but debris larger than a desired particle size are trapped, is provided. Drain 44 includes a resealable cap 44*a* which throughout the operation of the method of the present invention is kept sealed. When drainage is desired, cap 44 is unsealed and fluid is allowed to drain. When the pool 41 of water has been drained out of receptacle 40, paint layers 50 may be removed by conventional means. It is to be understood that paint layers 50 may be removed without draining pool 41 without departing from the novel scope of the present invention. Further, other means of removal of paint layers 50, such as by chemical liquification and drainage or burning, or other means, is anticipated and is not considered a departure from the novel scope of the present invention.

It is to be understood that the present invention is adaptable to carry any number of brackets to be cleaned on conveyor system 10, such that a savings in time, by quickly cleaning multiple brackets, is achieved. The system of the present invention may also be used to clean one bracket at a time without departing from the novel scope of the present invention. Finally, it is to be understood that other fluids (such as cleaning chemicals, and rust proofing or other protectants) may be sprayed using the system and method of the present invention, without departing from the novel scope of the present invention.

Although an illustrative embodiment of the invention has been shown and described, it is to be understood that various modifications and substitutions may be made by those skilled in the art without departing from the novel spirit and scope of the invention.

What is claimed is:

1. A cleaning system, comprising:

a conveyor;

a cleaning chamber about a portion of said conveyor;

a cleaning device within said cleaning chamber, said cleaning device operable to convey fluid towards an item to be cleaned; and a fluid-tight receptacle, beneath said conveyor and within said cleaning chamber, said receptacle having an elevated drainage member, such that fluid conveyed onto an item to be cleaned and substance removed from items to be cleaned, can drop into said receptacle, said fluid subsequently pouring into said elevated drainage member while substance removed from items to be cleaned remains in said receptacle.

2. The cleaning system of claim 1, wherein said cleaning fluid is water.

3. The cleaning system of claim 1, wherein said cleaning device comprises a robotic device which further comprises means to propel water at high speeds towards an item to be cleaned.

4. The cleaning system of claim 1, wherein said cleaning device can spray water under high pressure towards an item to be cleaned.

5. The cleaning system of claim 1, wherein said fluid-tight receptacle is a pool.

6. The cleaning system of claim 1, wherein said conveyor comprises an overhead path having at least one bracket for holding an item to be cleaned and conveying said item to said cleaning chamber.

7. The cleaning system of claim 6, wherein said bracket comprises hanging means for holding said item to be cleaned below said overhead path.

8. The cleaning system of claim 1, wherein said fluid-tight receptacle comprises a floor and walls sealedly attached to said floor so as to form a water-tight container.

9. The cleaning system of claim 8, wherein said elevated drainage member comprises a solid tube, having a first end sealedly connected to the floor of said fluid-tight receptacle and a second end, disposed above the floor of said fluid-tight receptacle, having a segment comprising drain openings.

10. The cleaning system of claim 1, wherein said cleaning system comprises a program which causes said conveyor to convey said item to be cleaned to said cleaning chamber, operates said cleaning device to clean said item to be cleaned, and conveys said item to be cleaned from said cleaning chamber.

11. A high pressure device, for removing paint from items, comprising:

a conveyor system;

a hanging bracket attached to said conveyor system;

a cleaning chamber about a portion of said conveyor system;

a directional high water pressure cleaner within said cleaning chamber; and, a pool, beneath said conveyor system, within said cleaning chamber, said pool having an elevated drainage member such that water sprayed, onto an item to be cleaned, and paint removed from items to be cleaned, drops into said pool, said water subsequently pouring into said drainage member while said paint falls to the bottom of said pool.

* * * * *